US005187962A

United States Patent [19]

Bilko et al.

[11] Patent Number: 5,187,962

[45] Date of Patent: Feb. 23, 1993

[54] APPARATUS AND METHOD FOR RESHAPING CONTAINERS

[75] Inventors: John P. Bilko; Stephen R. Arnell, both of Swindon; Andrew J. Boyd, Oxon; Perry A. Goodwin, High Wycombe, all of United Kingdom

[73] Assignee: CMB Foodcan PLC, United Kingdom

[21] Appl. No.: 903,219

[22] Filed: Jun. 23, 1992

[30] Foreign Application Priority Data

Jul. 4, 1991 [GB] United Kingdom ..... 9114444

[51] Int. Cl.[5] ..... B21D 26/02

[52] U.S. Cl. ..... 72/62; 72/367; 29/421.1

[58] Field of Search ..... 72/58, 61, 62, 367; 29/421.1

[56] References Cited

U.S. PATENT DOCUMENTS

| | | | |
|---|---|---|---|
| 3,335,590 | 8/1967 | Early | 72/58 |
| 3,461,699 | 8/1969 | Roth | 72/61 |
| 3,896,648 | 7/1975 | Schertenleib | 72/61 |

FOREIGN PATENT DOCUMENTS

| | | | |
|---|---|---|---|
| 1925014 | 11/1970 | Fed. Rep. of Germany | 72/62 |
| 2131811 | 6/1971 | Fed. Rep. of Germany . | |
| 388887 | 2/1963 | Switzerland . | |
| 2123329 | 2/1982 | United Kingdom . | |
| 2224965 | 8/1989 | United Kingdom . | |

*Primary Examiner*—David Jones

*Attorney, Agent, or Firm*—Diller, Ramik & Wight

[57] ABSTRACT

An apparatus for reshaping a container includes a mold of the split type. The container has a body member, a closed lower end member and a cone-shaped open upper end member. The mold has a pair of upper clamping members and a lower clamping member which slide along a liner. The upper clamping members and a seal for closing the container act on the double seam between the upper end member and the body member, thus ensuring that the upper end member and the double seam do not deform during reshaping. The seam between the lower end member and the body member is gripped between the lower clamping member and a support member. During reshaping, compressed air is supplied to the interior of the container, causing it to expand outwardly while the clamping members move inwardly.

14 Claims, 7 Drawing Sheets

APPARATUS AND METHOD FOR RESHAPING CONTAINERS

BACKGROUND OF THE INVENTION

The present invention relates to an apparatus for, and a method of, reshaping containers.

It is an object of this invention to provide a new or improved apparatus for, and a method of, reshaping a container.

SUMMARY OF THE INVENTION

According to one aspect of this invention, there is provided an apparatus for reshaping a hollow container having first and second ends, at least one of said first and second ends being open, said container comprising a body member and at least one end member joined to the body member by a double seam, said apparatus comprising a mold having an inner surface which defines a chamber for accommodating the container, first clamping means for clamping the container at said first end thereof with respect to the mold, second clamping means for clamping the container at said second end thereof with respect to the mold, means for sealing the or each open end of the container, means for supplying a fluid under pressure to the interior of the container so as to expand the container outwardly onto the inner surface of the mold, and means for preventing the or each double seam from deforming during expansion of the container.

According to a second aspect of this invention, there is provided a method of reshaping a hollow container having first and second ends, at least one of said first and second ends being open, said container comprising a body member and at least one end member joined to the body member by a double seam, said method comprising the steps of placing the container in a mold having an inner surface which defines a chamber for accommodating the mold, clamping the container at said first end thereof with respect to the mold, clamping the container at said second end thereof with respect to the mold, sealing the or each open end of the container, supplying a fluid under pressure to the interior of the container so as to expand the container outwardly onto the inner surface of the mold, and preventing the or each double seam from deforming during expansion of the container.

BRIEF DESCRIPTION OF THE DRAWINGS

This invention will now be described in more detail, by way of example, with reference to the drawings in which.

DETAILED DESCRIPTION OF THE PREFERRED EMBODIMENTS

Figure 1:
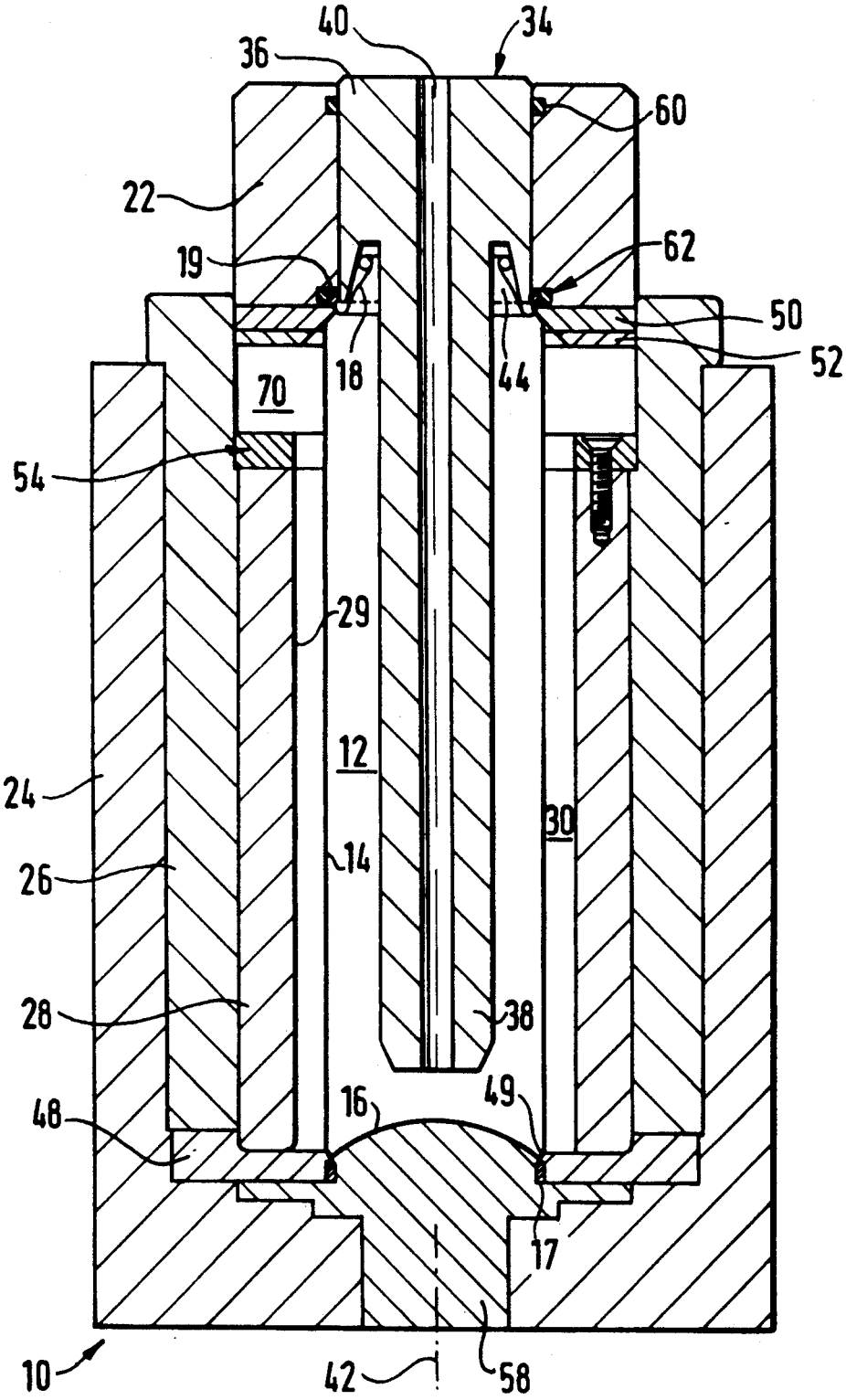
FIG. 1 is a longitudinal sectional view of a first apparatus for reshaping a container embodying this invention, the apparatus being shown with a container before reshaping.
Figure 2:
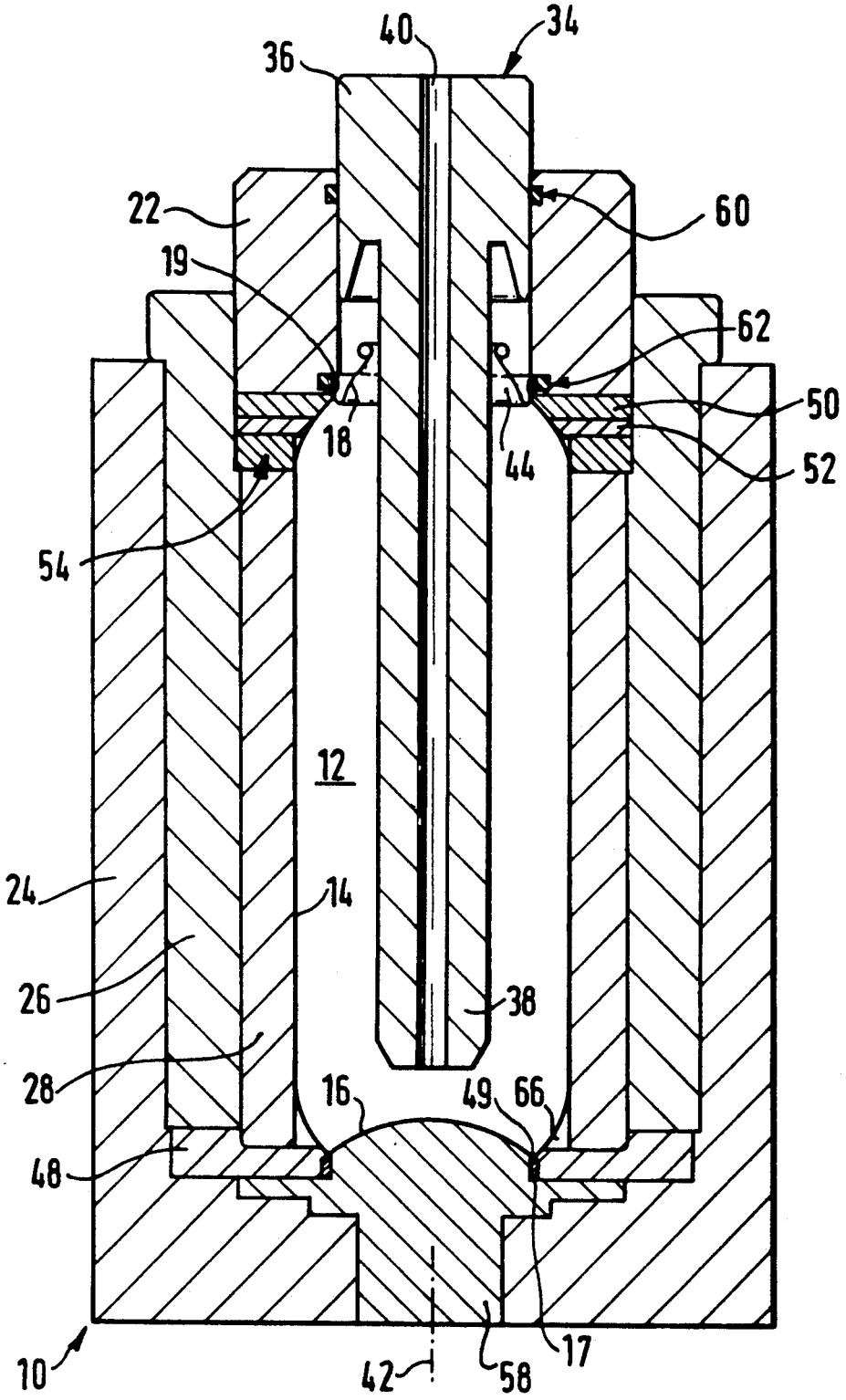
FIG. 2 is a longitudinal sectional view of the apparatus of FIG. 1 with the container after reshaping.

Referring now to FIGS. 1 and 2, there is shown an apparatus for reshaping a container. The apparatus comprises a mold 10 and this is shown together with a container 12. In FIGS. 1 and 2 the container 12 is shown, respectively, before and after reshaping.

The container 12 comprises a hollow cylindrical body member 14, a closed dome-shaped member 16 joined to the lower end of the body member 14 by a double seam 17 and an open cone-shaped end member 18 joined to the upper end of body member 14 by a double seam 19. The body member 14 is formed from a rectangular piece of steel sheet which is welded, in well known manner, into a cylindrical shape. The end members 16 and 18 are both formed from steel sheet. The various parts of the container 12 may be coated with stretchable lacquer or paint or polymer coating prior to reshaping. The container 12 is destined to form part of an aerosol dispensing container. In later stages of manufacture of the container, a valve cup is crimped to the upper end of the end member 18, a valve is clinched in place inside the valve cup and the container is filled with a product to be dispensed and a suitable propellant.

The mold 10 is of the split type. The mold 10 comprises an upper sleeve 22, an outer sleeve 24, an inner sleeve 26 and a liner 28. The inner surface 29 of liner 28 defines both a chamber to receive the container 12 and also the eventual desired outer shape of the container 12 after reshaping. As may be seen in FIG. 1, there is a cavity 30 between the container 12 before reshaping and the inner surface of the liner 28. As will be explained, during reshaping the container 12 expands outwardly through the cavity 30 onto the inner surface 29 of liner 28.

The apparatus also includes a mandrel 34 which has a head 36 and a shaft 38 located inside the mold. A passage 40 extends through the mandrel 34 along an axis 42 which is central both to the mandrel 34 and the mold 10. By way of modification, the single passage 40 may be replaced by several, for example three, passages. A deep groove 44 is formed in the head 36 adjacent the upper end of the shaft 38 and this groove 44 is arranged to receive the end member 18.

The apparatus further includes a lower clamping member 48 for clamping the lower end of the container 12 to the mold 10, and a pair of upper clamping members 50,52 for clamping the upper end of container 12 to the mold. The upper sleeve 22 and the upper clamping members 50,52 are arranged so that they can slide axially with respect to the mandrel 34 and the inner sleeve 26. In order to limit their axial movement, there is provided a spacer ring 54. The upper sleeve 22 and the upper clamping members 50,52 may slide freely or, preferably, be caused to slide in a controlled manner by a cam mechanism.

At its lower end, the apparatus includes a support member 58, the upper surface of which is complementary to the outer surface of the dome-shaped member 16 and which is brought into engagement therewith.

As may be observed in FIGS. and 2, the lower clamping member 48 engages the outer side of the double seam 17 and the support member 58 engages the inner side of the double seam 17. Thus, the double seam 17 is gripped between the lower clamping member 48 and the support member 58. Also, the lower clamping member 48 has an inwardly directed rib 49 which engages the outer part of the root of the double seam 17. Consequently, the root of the double seam 17 is gripped between the lower clamping member 48 and the support member 58. As a result of gripping the double seam 17 in this manner, it is prevented from deforming during reshaping. Furthermore, the support member 58 prevents the dome-shaped end member 16 from deforming during reshaping.

The apparatus also includes a pair of sealing rings 60,62 which together serve to seal the upper end of the container 12.

As may be observed in FIGS. 1 and 2, the clamping member 50 and the sealing ring 62 engage the container 12 at the double seam 19 between the body member 14 and the end member 18. As will be explained below, as a result of clamping and sealing the container 12 at the double seam 19, the end member 18 and the double seam 19 are prevented from deforming during reshaping.

As mentioned above, the mold 10 is of the split type. Thus, the upper sleeve 22, the outer sleeve 24, the inner sleeve 26 and the liner 28 are each formed in two halves. Likewise, the lower clamping member 48, the upper clamping members 50,52 and the spacer ring 54 are also each formed in two halves. The two halves of the mold 10 together with the associated components are mounted so that they can open to receive the container 12 and then close and lock together.

In operation, the two halves of the mold 10 are opened and the container 12 is placed on the mandrel 34. The two halves of the mold are then closed. After the two halves are closed, they are locked together by a locking mechanism and the locking mechanism provides the clamping force which is necessary to clamp the container 12 in position. Air under pressure is then supplied from an air supply system through the passage 40 to the interior of the container 12. This creates a pressure difference across the wall of the body member 14. Consequently, the container 12 is reshaped because the body member 14 expands outwardly into engagement with the inner surface of liner 28. As the body member 14 expands outwardly, the upper sleeve 22 and the clamping members 50,52 together with the sealing rings 60,62 slide downwardly (freely or in a controlled manner) until the clamping member 52 engages the spacer ring 54. Thus, the height of container 12 is reduced during reshaping. In order to ensure that the height of container 12 is reduced by the desired amount, the liner 28 and clamping member 48 are arranged so as to leave a cavity 66 after reshaping. The presence of the shaft 38 of mandrel 34 inside the container 12 during reshaping reduces the amount of air that has to be supplied.

The reduction in the height of container 12 provides various advantages as will now be explained.

The reduction in the height of the container reduces thinning of the material of the body member 12 in the vicinity of its ends during reshaping. It also ensures that the body member 12 is not drawn out of the clamping members 48,50 and 52. The reduction in height (negative axial strain) together with wall thinning (negative body material thickness strain) enables greater diameter expansion (positive hoop strain). Consequently, there is a saving in material. Containers having a relatively large diameter can be formed by reshaping containers made from relatively thin material and with relatively small diameter ends.

The reduction in material thinning during reshaping also makes it easier to use anisotropic materials as well as materials with grain direction oriented axially along the wall of the body member.

By permitting an end of the container to move axially inwardly during reshaping, the amount of energy required to reshape the container is reduced because the energy is expended only in circumferential stretching of the container body and not on axial stretching.

The apparatus described in FIGS. 1 and 2 also makes it possible to produce reshaped containers of various sizes and shapes from the same size and shape of container before reshaping. There is also a reduction in the number of parts that have to be changed when modifying the apparatus from producing one type of reshaped container to another type. Furthermore, stock holding of a variety of types of reshaped containers can be eliminated in favour of stock holding of a limited number of types of containers before reshaping.

Because the container 12 is clamped and sealed at the double seam 19 between the body member 12 and the end member 18, the air pressures on the inside and outside of end member 18 during reshaping are equal and this prevents deformation of the end member 18 and double seam 19.

Figure 3:
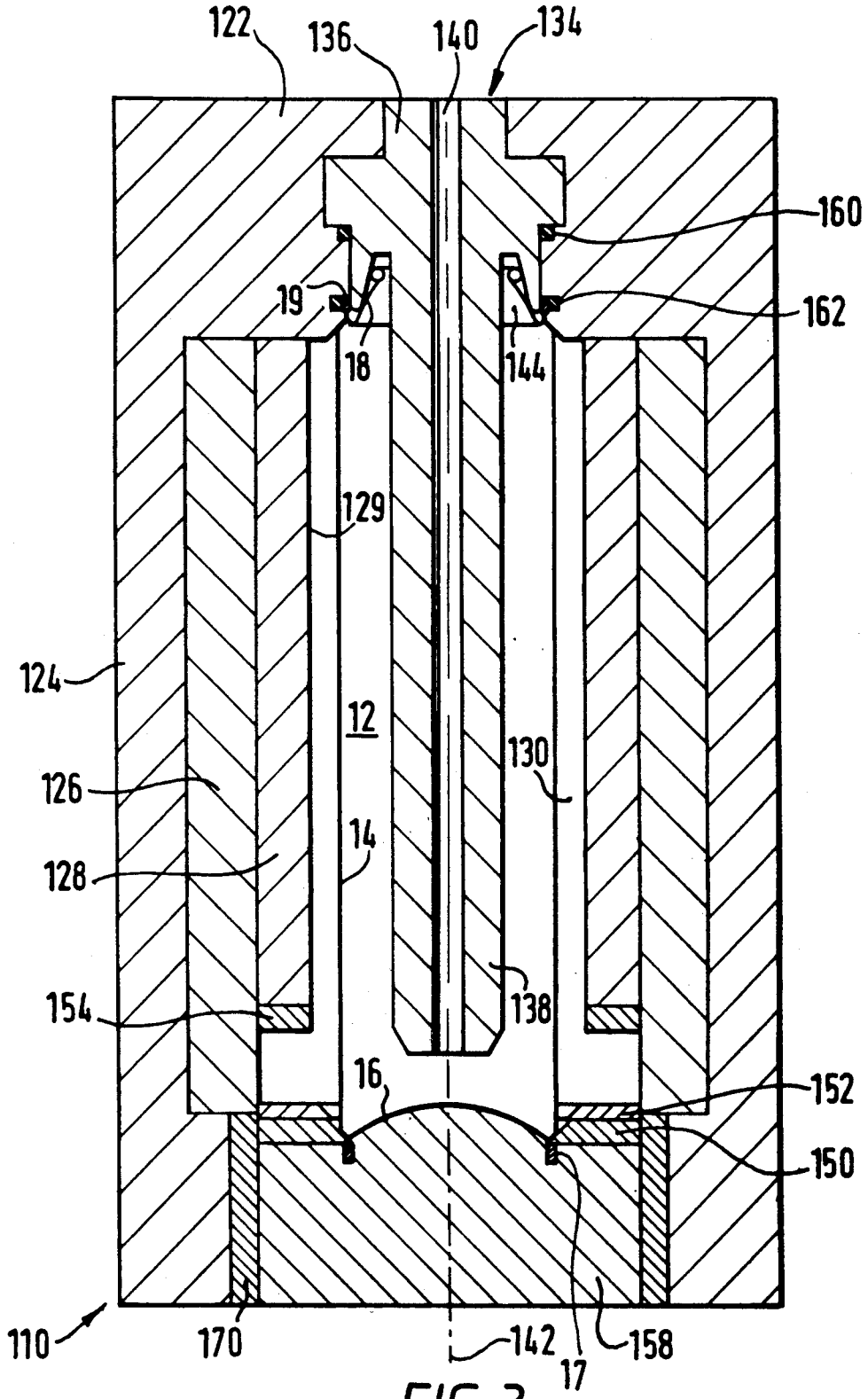
FIG. 3 is a longitudinal sectional view of a second apparatus for reshaping a container embodying the invention, the apparatus being shown with a container before reshaping.
Figure 4:
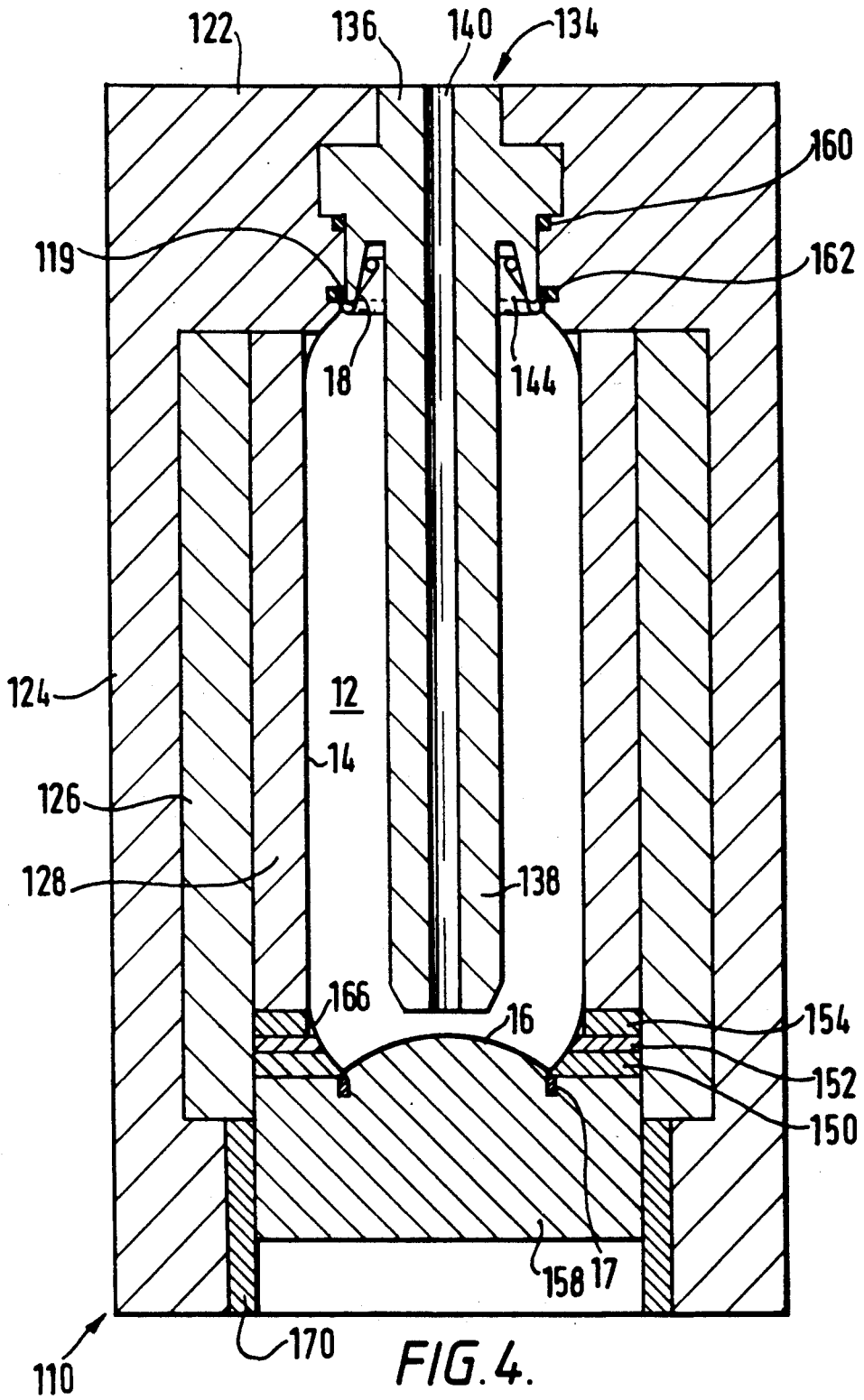
FIG. 4 is a longitudinal sectional view of the apparatus of FIG. 3 with the container after reshaping.

Referring now to FIGS. 3 and 4, there is shown another apparatus for reshaping containers which is generally similar to that shown in FIG. 1 and like parts are denoted by the same reference numerals preceded by number "1". The apparatus is shown in FIGS. 3 and 4 with a container 12, respectively, before and after reshaping.

In the apparatus of FIGS. 3 and 4, the upper sleeve 122 and the outer sleeve 124 are formed integrally. Consequently, the upper end of body member 14 does not move during reshaping.

Also, in the apparatus of FIGS. 3 and 4, the clamping member 48 of FIG. 1 is replaced by clamping members 150 and 152 which are arranged for sliding axial movement inside the lower end of the inner sleeve 126. Their axial movement is limited by a spacer ring 154. The lower end of the outer sleeve 124 is provided with a bearing sleeve 170 and the support member 158 is arranged to move axially inside the bearing sleeve 170 and the inner sleeve 126. The support member 158 and the clamping members 150,152 may slide freely or, preferably, be caused to slide in a controlled manner by a cam mechanism. The double seam 17 is gripped between the support member 158 and the clamping member 150.

Thus, in operation, in the apparatus of FIGS. 3 and 4, the lower end of the container body 14 moves upwardly, thereby providing a reduction in the height of container 12.

Figure 5:
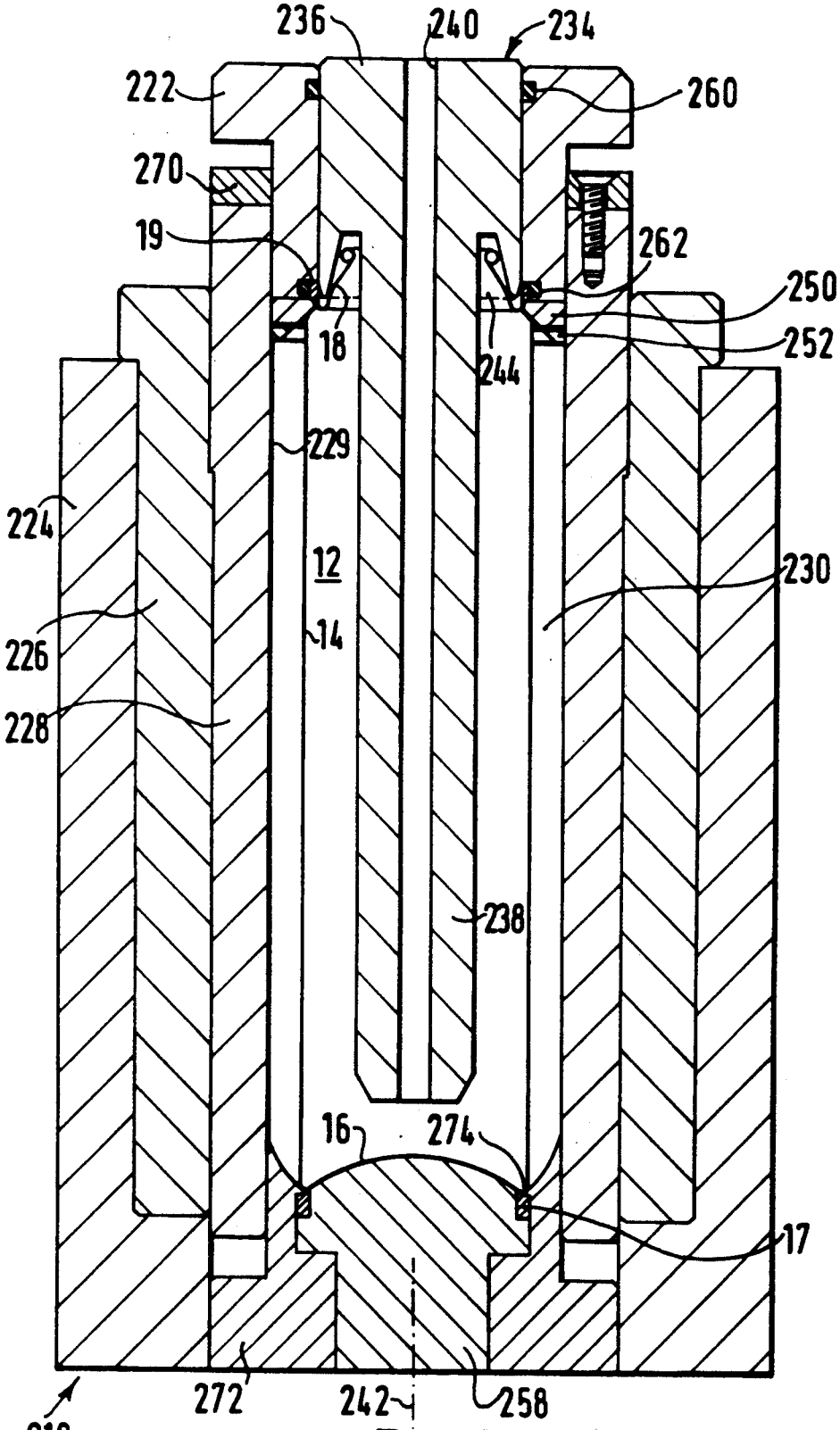
FIG. 5 is a longitudinal sectional view of a third and preferred apparatus for reshaping a container embodying the invention, the apparatus being shown with a container before reshaping.
Figure 6:
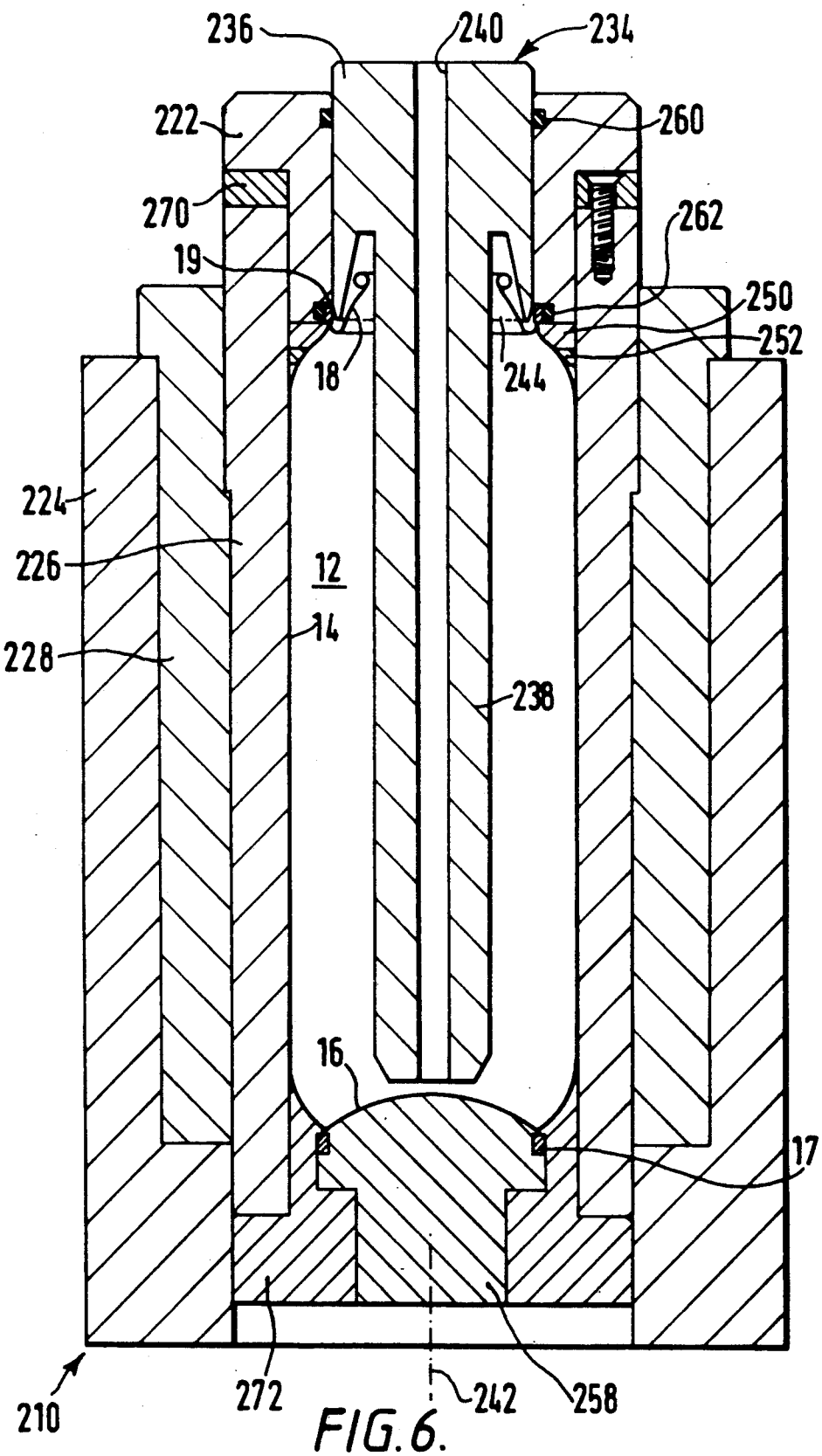
FIG. 6 is a longitudinal sectional view of the apparatus of FIG. 5 with the container after reshaping.

Referring now to FIGS. 5 and 6, there is shown a further and preferred apparatus for reshaping containers. The apparatus shown in FIGS. 5 and 6 is generally similar to that shown in FIG. 1 and like parts are denoted by the same reference numerals preceded by number "2". The apparatus is shown in FIGS. 5 and 6 with a container 12, respectively, before and after reshaping.

In the apparatus of FIGS. 5 and 6, the upper sleeve 222 and the upper clamping members 250,252 slide along the inner surface of the liner 228. The axial movement of the upper sleeve 222 is limited by a spacer ring 270.

In place of the clamping member 48 of FIG. 1, there is provided a lower clamping member 272 which is guided for axial sliding movement by the outer sleeve 224 and the inner surface 229 of the liner 228. The support member 258 is arranged to move together with the lower clamping member 258. The double seam 17 is gripped between the lower clamping member 272 and the support member 258. The lower clamping member 272 has an inwardly directed rib 274 and the root of the double seam 17 is gripped between the rib 274 and the support member 258.

In operation, the upper clamping members 250,252 and the lower clamping member 272 move inwardly and towards each other during reshaping of the container 12.

In the apparatus shown in FIG. 1, before reshaping of the container 12 there is a gap 70 between the clamping member 52 and the spacer ring 54. There is a risk that the wall of the container body 14 might expand into this gap 70. Careful design is needed to minimize this risk. In the apparatus of FIG. 5, the clamping members 250,252,272 slide along the inner surface 229 of the lining member 228 and there is no gap corresponding to the gap 70 of the apparatus of FIG. 1. Consequently, the risk just described in relation to the apparatus of FIG. 1 does not exist in the apparatus of FIG. 5.

The apparatuses of FIGS. 1 and 2, 3 and 4, and 5 and 6 may be modified for reshaping other types of container.

For example, each apparatus may be used to reshape a container of the type comprising a hollow container body having a rectangular cross-section, a closed end member, and an open end member which is provided with a screwthread for receiving a threaded cap. Each apparatus may be used for reshaping a container of the type in which the closed end member and the body member are formed integrally by a drawing process.

There will now be described a system for supplying air under pressure to the apparatus of FIGS. 1 and 2 or the apparatus or FIGS. 3 and 4 or the apparatus of FIGS. 5 and 6. The system will be described with reference to the apparatus of FIGS. 1 and 2.

Figure 7:
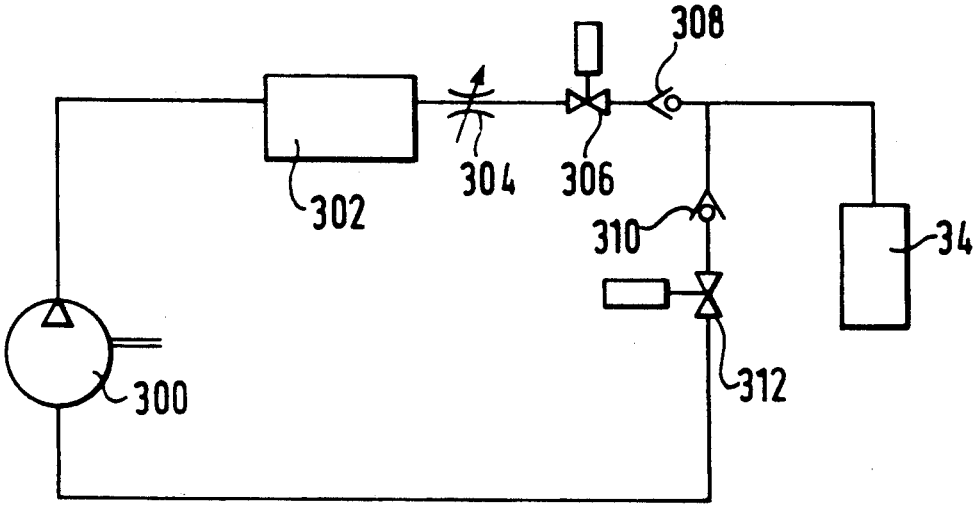
FIG. 7 shows an air supply system which may form part of any one of the apparatuses of FIGS. 1 to 6.

Referring now to FIG. 7, the air supply system comprises a three stage compressor 300 which supplies compressed air to an accumulator 302. The output of the accumulator 302 is connected through an adjustable restrictor 304, a solenoid operated valve 306 and a one-way valve 308 to the mandrel 34. The mandrel is also connected through a one-way valve 310 and a solenoid operated valve 312 to the input of compressor 300.

In operation, the valve 306 is opened and the container 12 is subjected to a pressure of, for example 50-60 bar, so that it takes up its shape inside the mold 10. The valve 306 is then closed and the valve 312 is opened so as to return the compressed air to the compressor 300.

Air represents a particularly convenient type of fluid for reshaping containers. However, it is to be appreciated other types of fluid may be used in place of air.

We claim:

1. An apparatus for reshaping a hollow container having first and second ends, at least one of said first and second ends being open, said container comprising a body member and at least one end member joined to the body member by a double seam, said apparatus comprising a mold having an inner surface which defines a chamber for accommodating the container, first clamping means for clamping the container at said first end thereof with respect to the mold, second clamping means for clamping the container at said second end thereof with respect to the mold, means for sealing the or each open end of the container, means for supplying a fluid under pressure to the interior of the container so as to expand the container outwardly onto the inner surface of the mold, and means for preventing the or each double seam from deforming during expansion of the container.

2. An apparatus as claimed in claim 1, in which said at least one end member of the container includes an open end member joined to the body member by a double seam at said first end of the container, and the first clamping means and the means for sealing the first end of the container are arranged to act on the container in the vicinity of the double seam between said open end member and the container body and thereby provide the means for preventing the double seam between said open end member and the container body from deforming during expansion of the container.

3. An apparatus as claimed in claim 1, in which said at least one end member of the container includes a closed end member joined to the body member by a double seam at said second end of the container, and the second clamping means is arranged to grip the walls of the double seam between said closed end member and the container body together and thereby provide the means for preventing the double seam between the closed end member and the container body from deforming during expansion of the container.

4. An apparatus as claimed in claim 3, including means for supporting the external surface of said closed end member of the container so as to prevent deformation of said closed end member as the container expands outwardly onto the inner surface of the mold.

5. An apparatus as claimed in claim 1, in which at least one of said first and second clamping means is arranged to move inwardly towards the other clamping means as the container expands.

6. An apparatus as claimed in claim 5, in which both clamping means are arranged to move inwardly towards each other as the container expands outwardly.

7. An apparatus as claimed in claim 1, in which at least one of said first and second clamping means is arranged to slide inwardly along the inner surface of the mold towards the other clamping means as the container expands outwardly.

8. An apparatus as claimed in claim 7, in which both clamping means are arranged to slide inwardly along the inner surface of the mold towards each other as the container expands outwardly.

9. An apparatus as claimed in claim 1, including a mandrel located in the chamber and having a passage formed therein to supply fluid to the interior of the container through a passage formed therein.

10. A method of reshaping a hollow container having first and second ends, at least one of said first and second ends being open, said container comprising a body member and at least one end member joined to the body member by a double seam, said method comprising the steps of placing the container in a mold having an inner surface which defines a chamber for accommodating the mold, clamping the container at said first end thereof with respect to the mold, clamping the container at said second end thereof with respect to the mold, sealing the or each open end of the container, supplying a fluid under pressure to the interior of the container so as to expand the container outwardly onto the inner surface of the mold, and preventing the or each double seam from deforming during expansion of the container.

11. A method of reshaping a hollow container as claimed in claim 10, in which said at least one end member of the container includes an open end member joined to the body member by a double seam at said first end of the container, and, in said steps of clamping and sealing said first end of the container, the container is clamped and sealed in the vicinity of the double seam between said open end member and the container body so as to perform thereby said step of preventing the double seam between said open end member and the container body from deforming during expansion of the container.

12. A method of reshaping a hollow container as claimed in claim 10, in which said at least one end member of the container includes a closed end member joined to the body member by a double seam at said end of the container, and, in said step of clamping said second end of the container, the walls of the double seam between said closed end member and the container body are gripped together so as to perform thereby said step of preventing the double seam between said closed end member and the container body from deforming during expansion of the container.

13. A method as claimed in claim 12, including the step of supporting the external end surface of said closed end member of the container so as to prevent deformation of said closed end member as the container expands outwardly onto the inner surface of the mold.

14. A method as claimed in claim 10, including the step of permitting at least one end of the mold to move inwardly towards the other end as the container expands onto the inner surface of the mold.

* * * * *